US007136088B2

(12) United States Patent
Yoshida et al.

(10) Patent No.: US 7,136,088 B2
(45) Date of Patent: Nov. 14, 2006

(54) SUPPORT APPARATUS AND IMAGE FORMING APPARATUS

(75) Inventors: Yasutoshi Yoshida, Tochigi (JP); Takahiko Kitano, Tochigi (JP); Yutaka Higurashi, Tochigi (JP); Takashi Ueda, Tochigi (JP); Toshinori Kobayashi, Tochigi (JP); Toshiyuki Takatsu, Tochigi (JP); Nozomu Oishi, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 359 days.

(21) Appl. No.: 10/847,457

(22) Filed: May 18, 2004

(65) Prior Publication Data

US 2005/0168565 A1 Aug. 4, 2005

(30) Foreign Application Priority Data

Feb. 2, 2004 (JP) ..... 2004-025311

(51) Int. Cl.
*B41J 27/00* (2006.01)

(52) U.S. Cl. ..... 347/242; 347/257

(58) Field of Classification Search ..... 347/152, 347/241–245, 255–261, 263, 239; 359/196
See application file for complete search history.

(56) References Cited

U.S. PATENT DOCUMENTS 5,633,744 A * 5/1997 Nakajima ..... 359/196
6,982,736 B1 * 1/2006 Okugawa et al. ..... 347/152

FOREIGN PATENT DOCUMENTS

JP 10-153744 6/1998
JP 2002-162590 6/2002

* cited by examiner

*Primary Examiner*—Hai Pham
(74) *Attorney, Agent, or Firm*—Greenblum & Bernstein, P.L.C.

(57) ABSTRACT

A support apparatus is configured to ease the series of work operations for adjusting the height of laser scan unit. The support apparatus supports a laser scan unit which is utilized within an image forming apparatus. The support apparatus see has a mounting plate which has laser scan unit mounted thereon. The laser scan unit cooperates with a photo conductor when the laser scan unit is mounted on mounting plate. The support apparatus has a support wall which supports the mounting plate within a cabinet. The support wall extends vertically within the image forming apparatus. An adjustment mechanism is positioned along the vertical extent of the support wall and adjusts a height of an end of the mounting plate.

21 Claims, 16 Drawing Sheets

SUPPORT APPARATUS AND IMAGE FORMING APPARATUS

FIELD OF THE INVENTION

The present invention relates to a support apparatus for supporting a laser scan unit that irradiates the surface of an image support body with a light beam, said support apparatus supporting the laser scan unit through support members, within an image forming apparatus, facing the image support member, and further relates to the image forming apparatus comprising the image support body, the laser scan unit, and support members therein.

DESCRIPTION OF RELATED ART

A conventional image forming apparatus (printers, image transmission devices, photocopiers and the like) is equipped with a laser scan unit that creates an undeveloped electrostatic image on the surface of a light-sensitive body by exposing the surface with a light beam. This type of laser scan unit is supported by a support apparatus that can finely adjust the scanning direction so that the light bean scans a specific point on the light-sensitive body. After the laser scan unit is positioned at the appropriate point, the laser scan unit is tightened at the appropriate point by screws (see reference documents 1 and 2).

[Reference Document 1]

Japanese Laid Kokai (laid open) Patent Publication H10-153744 (FIG. 1).

[Reference Document 2]

Japanese Kokai (laid open) Patent Publication 2002-162590 (FIG. 2)

Because a conventional support apparatus supports the laser scan unit through a frame that must be secured from the top by screws, it becomes necessary to adjust the position of the laser scan unit and to tighten the laser scan unit by the screws from the region above the laser scan unit. This type of apparatus presents less of a problem if the laser scan unit is mounted within the upper region of the image forming apparatus. However, various problems can occur if the laser scan unit is structured so as to be mounted in the center or at the bottom of the image forming apparatus.

To explain further, mounting the laser scan unit at the center or bottom of the image forming apparatus requires that the technician assemble the image forming apparatus, by continuing to peer down into the image forming apparatus from an opening at the top, before the laser scan unit can be adjusted. This reduces the productivity of the adjustment operation. Also, the adjustment cannot be conducted after the device in which the laser scan unit is installed has been completely assembled because components that are located in the image forming apparatus over the laser scan unit must be removed in order to provide access to the laser scan unit for the adjustment. Moreover, when printing a test image, the laser scan unit must be covered by the components located above the laser scan unit in order to prevent outside-light from irradiating the light-sensitive element. This makes the adjustment of the laser scan unit, which must be conducted while checking the results of test prints, an extremely troublesome job.

SUMMARY OF THE INVENTION

The present invention puts forth a support apparatus and an image forming apparatus to eliminate the aforesaid problems in the current art. The main purpose of the support apparatus and the image forming apparatus is to allow the technician to do the aforesaid series of operations with a comfortable position, to allow adjustment of the laser scan unit even after the device into which the laser scan unit is installed has been completely assembled, and to allow the technician to conveniently produce test images while conducting the adjustment operation.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The embodiments of the present invention are explained in the following, in reference to the above-described drawings.

First Embodiment

Figure 1:
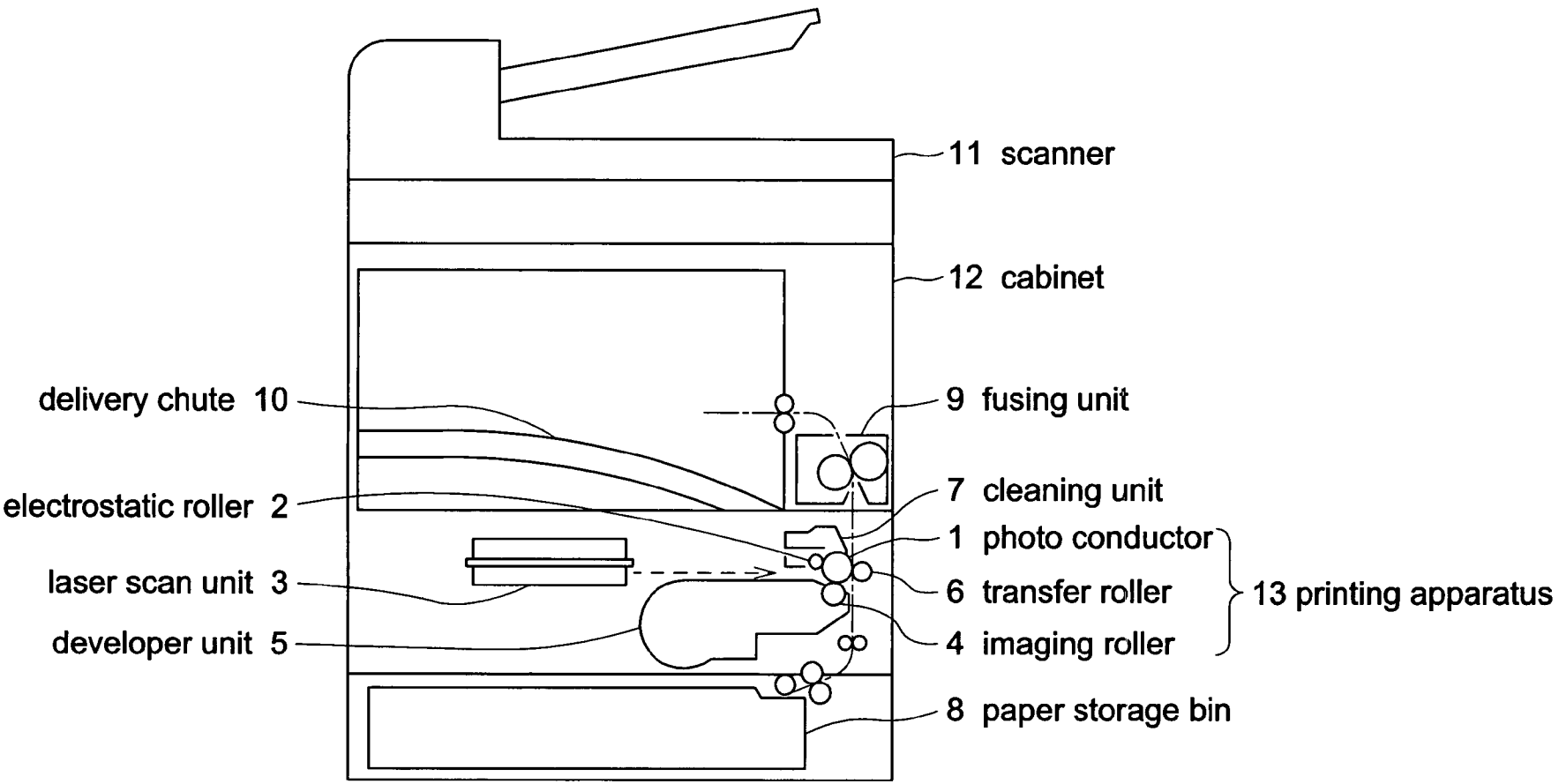
FIG. 1 is a diagrammatic cross section of an image forming apparatus of the type to which the present invention can be appropriately applied.

FIG. 1 is a diagrammatic cross section of an image forming apparatus of the type to which the present invention can be appropriately applied. The image forming apparatus includes photo conductor (image support body) 1. In the vicinity of photo conductor 1, electrostatic roller 2 is arranged. Electrostatic roller 2 applies a uniform electrostatic charge to the surface of photo conductor 1. Laser scan unit 3 forms a undeveloped electrostatic image on the surface of photo conductor 1 by exposing the surface with a light beam. Developer unit 5 includes imaging roller 4 that applies toner to develop the undeveloped electrostatic image on photo conductor 1. Transfer roller 6 transfers the toner image on photo conductor 1 to recording paper. Cleaning unit 7 cleans the surface of photo conductor 1. After passing between photo conductor 1 and transfer roller 6, recording paper from paper storage 8 exits through delivery chute 10 via fusing unit 9. In addition, scanner 11 is installed above the image forming apparatus in order to scan an original document for copying or sending as a facsimile transmission.

printing apparatus 13, which includes photo conductor 1 (on which the image is generated), laser scan unit 3, and other components, is located beneath delivery chute 10 in the relatively lower region of cabinet 12. Laser scan unit 3 is oriented in the approximate horizontal direction facing photo conductor 1, and the axis of light is oriented in the approximate horizontal direction. The light beam emitted by laser scan unit 3 travels through the passage between developer unit 5 and electrostatic roller 2 to irradiate photo conductor 1.

Figure 2:
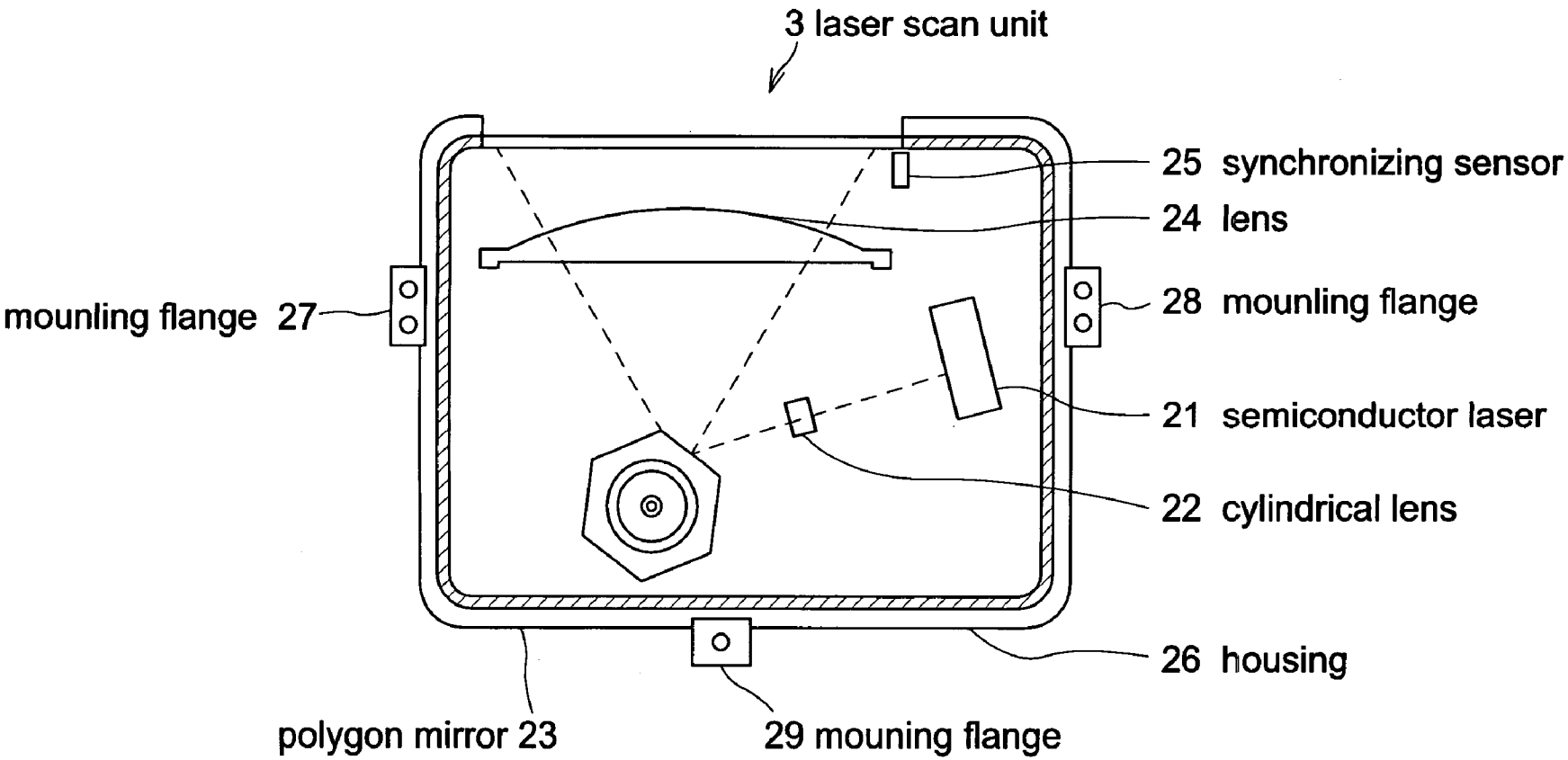
FIG. 2 is a diagrammatic cross section of the laser scan unit shown in FIG. 1.

FIG. 2 is a diagrammatic cross section of the laser scan unit shown in FIG. 1. Laser scan unit 3, which can also be referred to as an LSU, includes semiconductor laser (light source) 21. Semiconductor laser 21 emits a laser beam. Cylindrical lens (first optical system) 22 focuses the light beam emitted from semiconductor laser 21. Polygon mirror 23 deflects the focused light beam in order to scan it across the surface of photo conductor 1. Lens (second optical system) 24 forms the deflected and scanned light beam from polygon mirror 23 onto the surface of photo conductor 1. Synchronizing sensor 25 monitors the timing of the laser beam, and housing 26 serves as a cover.

First and second mounting flanges 27 and 28 are attached to opposing edges of laser scan unit 3 in the scanning direction. Also, third mounting flange 29 is provided at the approximate center and oriented in the scanning direction on the side of laser scan unit 3 opposite to photo conductor 1.

Figure 3:
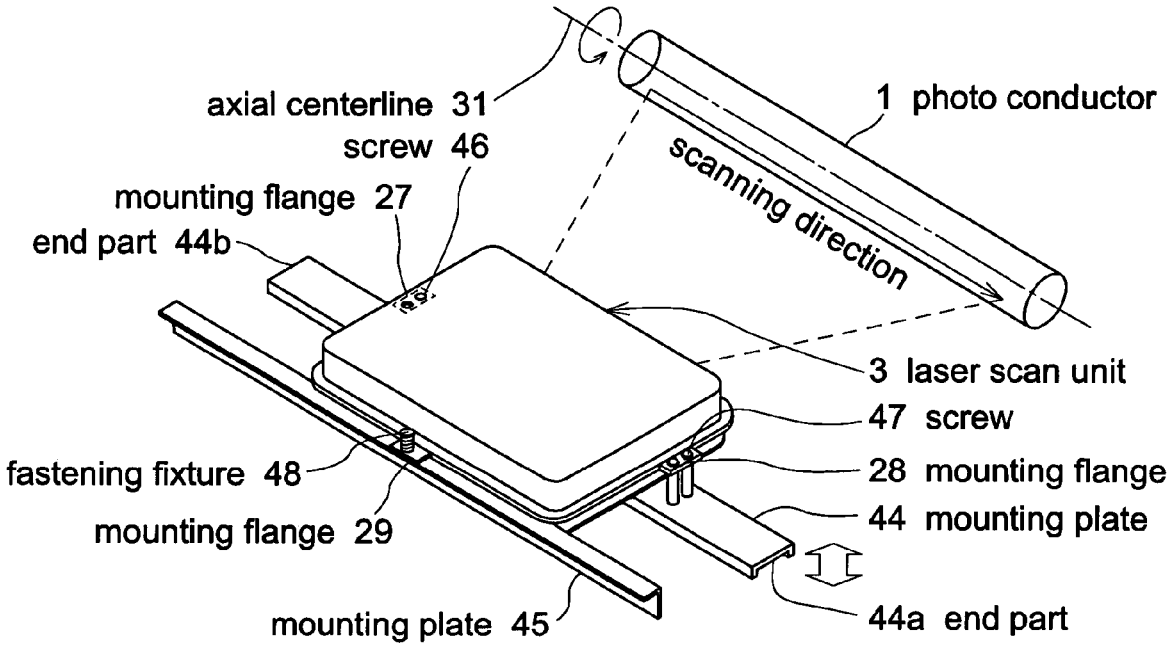
FIG. 3 is a perspective view of the photo conductor and laser scan unit shown in FIG. 1.

FIG. 3 is a perspective view of the photo conductor and laser scan unit shown in FIG. 1. Laser scan unit 3, by means of the deflector installed therein, scans the surface of photo conductor 1 while a secondary scanning action is executed by the rotation of photo conductor 1, which is circular in cross section, around its axial centerline 31.

Figure 4:
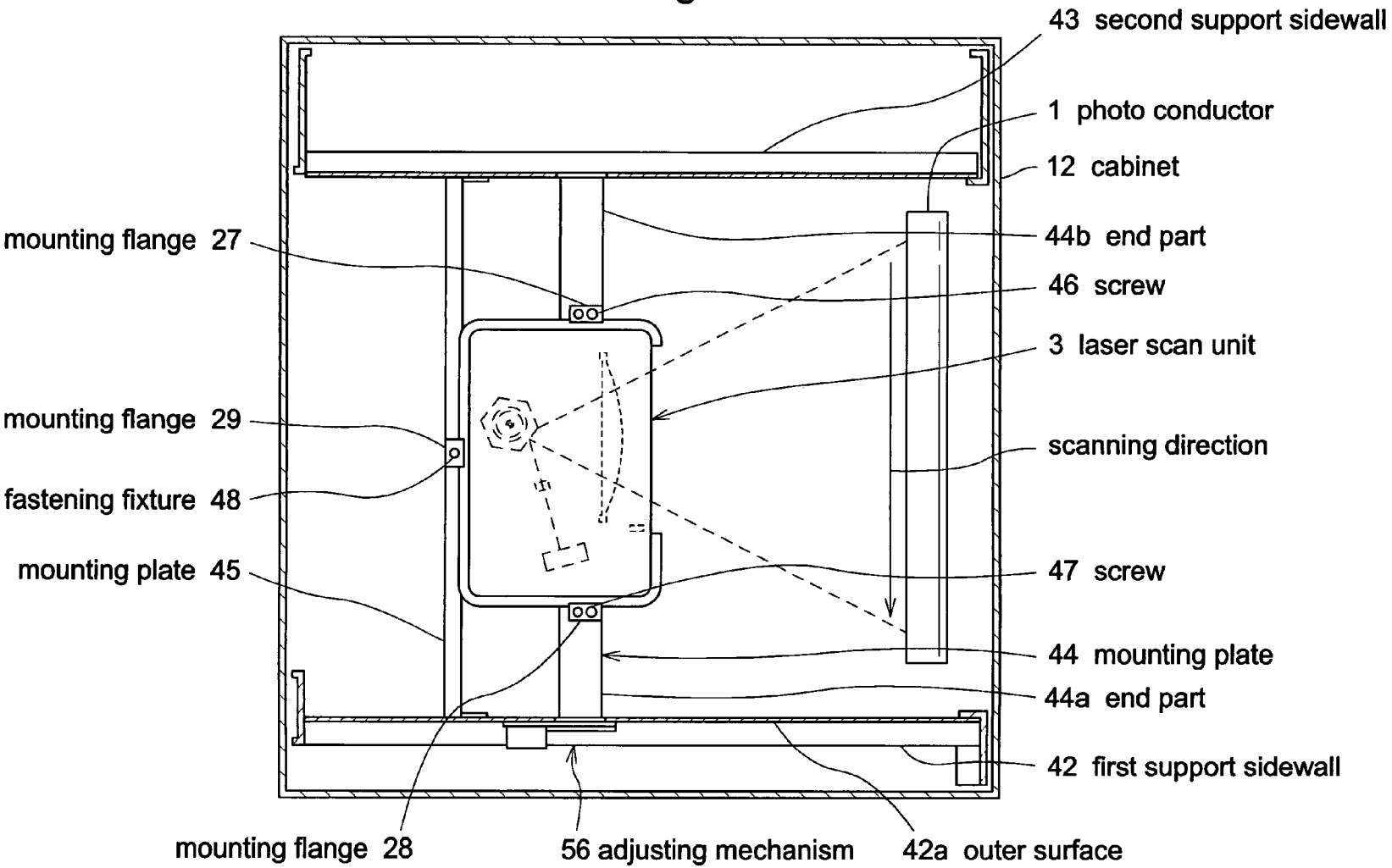
FIG. 4 is a top view of the structure that supports the laser scan unit shown in FIG. 1.

FIG. 4 is a top view of the support structure of the laser scan unit shown in FIG. 1. First support sidewall 42 is provided on one sidewall of cabinet 12 (within which the image forming apparatus is installed), and second support sidewall 43 is provided on the opposing sidewall. First and second mounting plates 44 and 45 are suspended between first and second support sidewalls 42 and 43 on the approximate horizontal plane along the scanning axis of laser scan unit 3.

Laser scan unit 3 is supported by first and second mounting plates 44 and 45, and attached to first mounting plate 44 by means of screws 46 and 47 which fasten first and second mounting flanges 27 and 28 so as to form a one-piece structure with first mounting plate 44. Moreover, laser scan unit 3 is attached to second mounting plate 45 by means of fastening fixture 48 that secures mounting flange 29 thereto, mounting flange 29 being located on laser scan unit 3 on the side opposite photo conductor 1.

Figure 5:
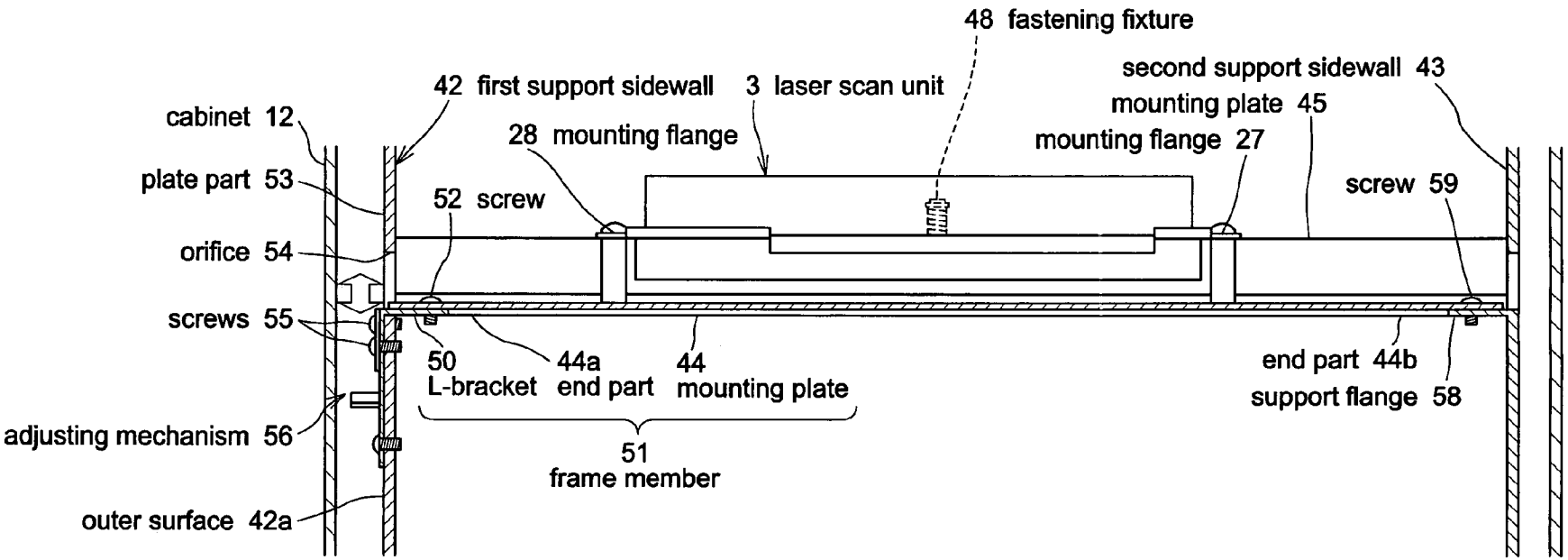
FIG. 5 is a side view of the structure supporting the laser scan unit shown in FIG. 1.

FIG. 5 is a side view of the support structure of the laser scan unit shown in FIG. 1. End part 44*a*, which is one extremity of first mounting plate 44, is fixed to first support sidewall 42 through L-bracket 50 which is "L" shaped in cross section. L-bracket 50 and first mounting plate 44 form frame member 51, to which laser scan unit 3 is fixedly attached, as a single movable structure. One end of L-bracket 50 is connected to first mounting plate 44 through screw 52, and the other end of L-bracket 50, which passes through orifice 54 in plate part 53 of first support sidewall 42 and also extends through outer surface 42*a* of first support structure 42, is attached to first support sidewall 42 by screws 55.

Adjustment mechanism 56, which provides means of adjusting the scanning position of laser scan unit 3, is provided at outer surface 42*a* of first support sidewall 42, and is oriented at an approximate right angle to the scanning plane of laser scan unit 3; that is, adjustment mechanism 56 is located so as to displace end part 44*a* of first mounting plate 44 in the vertical direction.

End part 44*b*, which is the other extremity of first mounting plate 44, is fixedly attached to second support sidewall 43 through screw 59 that secures end part 44*b* to support flange 58. Support flange 58 protrudes from the inner surface of second support sidewall 43 as a result of being bent inward along an approximately horizontally oriented bend line. When adjustment is executed through adjustment mechanism 56, the vertical bending movement of support flange 58 on second support sidewall 43 allows the positional displacement of end part 44*a* of first mounting plate 44.

As shown in FIG. 3, the position of laser scan unit 3 can be set by adjustment mechanism 56 through the adjustment of one end of laser scan unit 3 along the scanning axis, that is, an adjustment that vertically displaces end part 44*a* of first mounting plate 44 at an approximate right angle to the scanning direction. The attitude of laser scan unit 3 is supported at the other end of the scanning direction, that is, through the support provided by end part 44*b* at the other end of mounting plate 44. Therefore, the scanning position, particularly corrections to the inclination angle of the scanning direction, can be set in relation to axial centerline 31 of photo conductor 1 which serves as the reference line. The correction of the scanning direction can also be effective as means of compensating for paper inclination generated by the paper transport mechanism.

Figure 6:
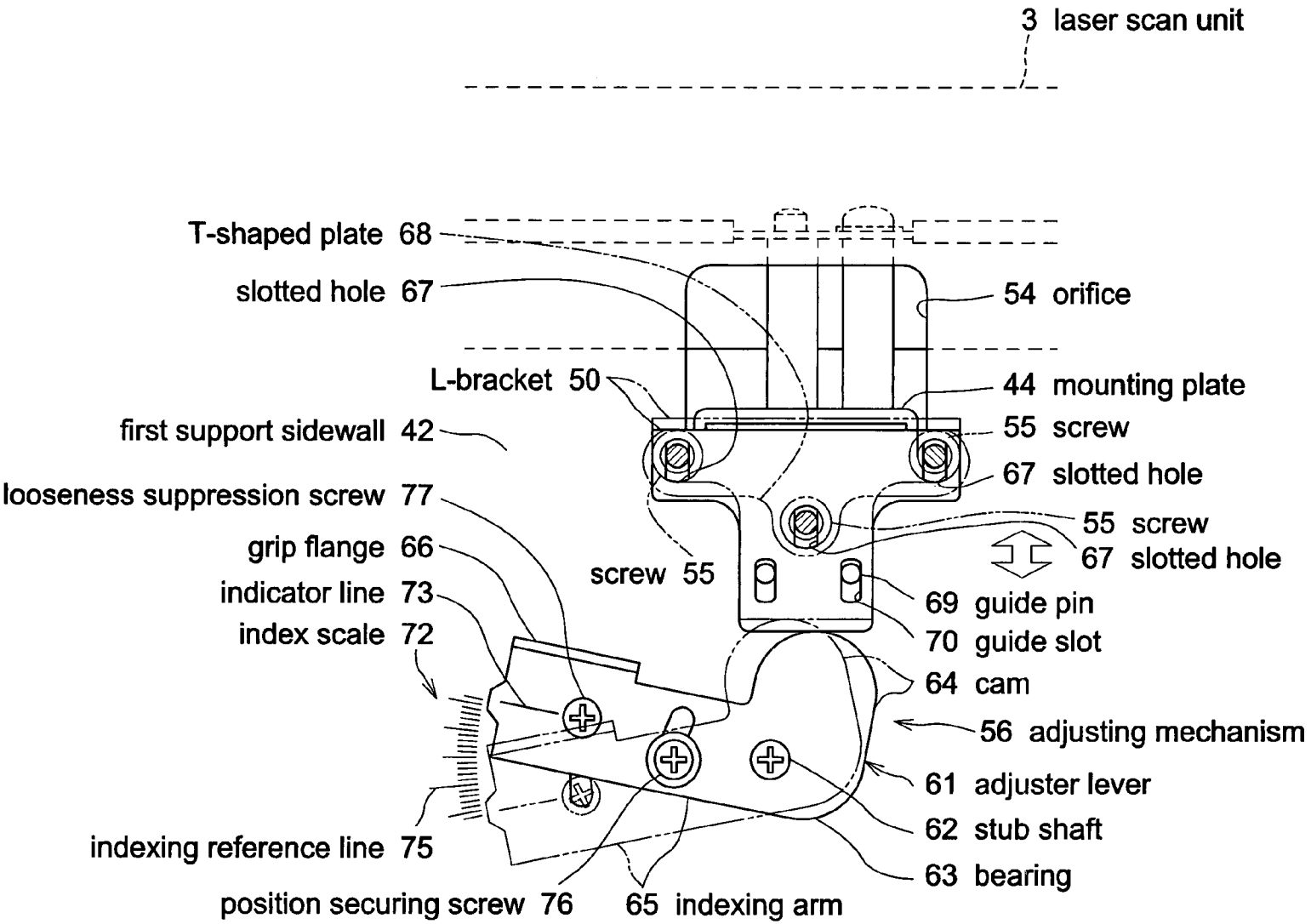
FIG. 6 is a detail frontal view of the adjustment structure of FIG. 5.

FIG. 6 is a detailed frontal view of the adjustment mechanism shown in FIG. 5. Adjustment mechanism 56 includes adjuster lever 61 which is able to displace first mounting plate 44 in relation to first support sidewall 42 through one edge of adjuster lever 61. The one edge of adjuster lever 61 contacts L-bracket 50 which is attached to first mounting plate 44. Adjuster lever 61 is pivotally attached to support sidewall 42 through stub shaft 62, incorporates cam 64 which extends upward from bearing 63 of stub shaft 62 to ride against L-bracket 50, indexing arm 65 that extends horizontally from bearing 63, and grip flange 66 which is formed on the leading edge of indexing arm 65.

Cam 64 is formed as a curved external surface with a continually changing radius in relation to stub shaft 62, and can move L-bracket 50 in an upward or downward direction corresponding to the rotational angle of adjuster lever 61. In other words, manually grasping grip flange 66 of adjuster lever 61 and moving it downward rotates adjuster lever 61 counter-clockwise (as viewed in FIG. 6) with the result that cam 64 pushes L-bracket 50 in an upward direction. Conversely, moving grip flange 66 upward rotates adjuster lever 61 in a clockwise direction (as viewed in FIG. 6) which has the effect of allowing L-bracket 50 to move downward as a result of the weight applied by laser scan unit 3 which is attached thereto.

Vertically oriented slotted holes 67 are formed in L-bracket 50 to allow the vertically adjustable fixed attachment of L-bracket 50 to first support sidewall 42 through screws 55, and thereby allowing the height of L-bracket 50 to be adjusted by loosening screws 55. T-shaped plate 68 is placed between L-bracket 50 and the heads of screws 55 to allow screws 55 to be tightened to a higher torque value.

Guide slots 70 are formed in L-bracket 50, and guide pins 69 protrude from first support sidewall 42. The insertion of guide pins 69 into guide slots 70 restricts the lateral movement of L-bracket 50 while allowing the vertical positioning adjustment.

Indicator line 73, which is scribed on the end portion of indexing arm 65 opposite to index scale 72, and index scale 72, which is scribed on first support sidewall 42, form a mechanical display that shows the amount of adjustment applied to laser scan unit 3, said adjustment being indicated through the relative angle of adjuster lever 61 in respect to first support sidewall 42. This indicator mechanism makes the adjustment operation easier because the technician is able to execute the adjustment while checking the extent that laser scan unit 3 has been moved. This is especially convenient in cases where laser scan unit 3 is to be replaced because the position of laser scan unit 3 can be verified before replacement, and the adjustment applied to the newly installed laser scan unit 3 can begin at the position of the previous laser scan unit 3, thus it is possible to shorten the time for the adjustment.

The radial length of indexing arm 65 of adjuster lever 61 is established to provide an enlarged visual indication, through indictor line 73, of the extent of adjustment applied to laser scan unit 3. In other words, stub shaft 62 of adjuster lever 61 is located nearer to cam 64 than to indicator line 73. This allows indicator line 73 to move through a wider indication range in respect to the amount of vertical displacement of L-bracket 50, which is in contact with cam 64, and in respect to the corresponding extent of adjustment of laser scan unit 3. For example, 0.1 mm of movement of L-bracket 50 may be indicated by a 1 mm movement of indicator line 73. Moreover, the locations of the indexed scale and indicator line may be reversed, that is, the indexed scale may be provided on the adjuster lever and indicator line on the support sidewall.

Indexed scale 72, which is scribed into first support sidewall 42, includes index reference line 75 which is longer than the other indexing lines as means of denoting a reference position for laser scan unit 3. The adjustment operation starts by aligning indicator line 73 with index reference line 75. A test print is run, and then the scanning position is determined based on the test print. Adjustments are made in the necessary direction while noting the position of indicator line 72.

Position securing screw 76 and looseness suppression screw 77 are attached to adjuster lever 61.

Figure 7:
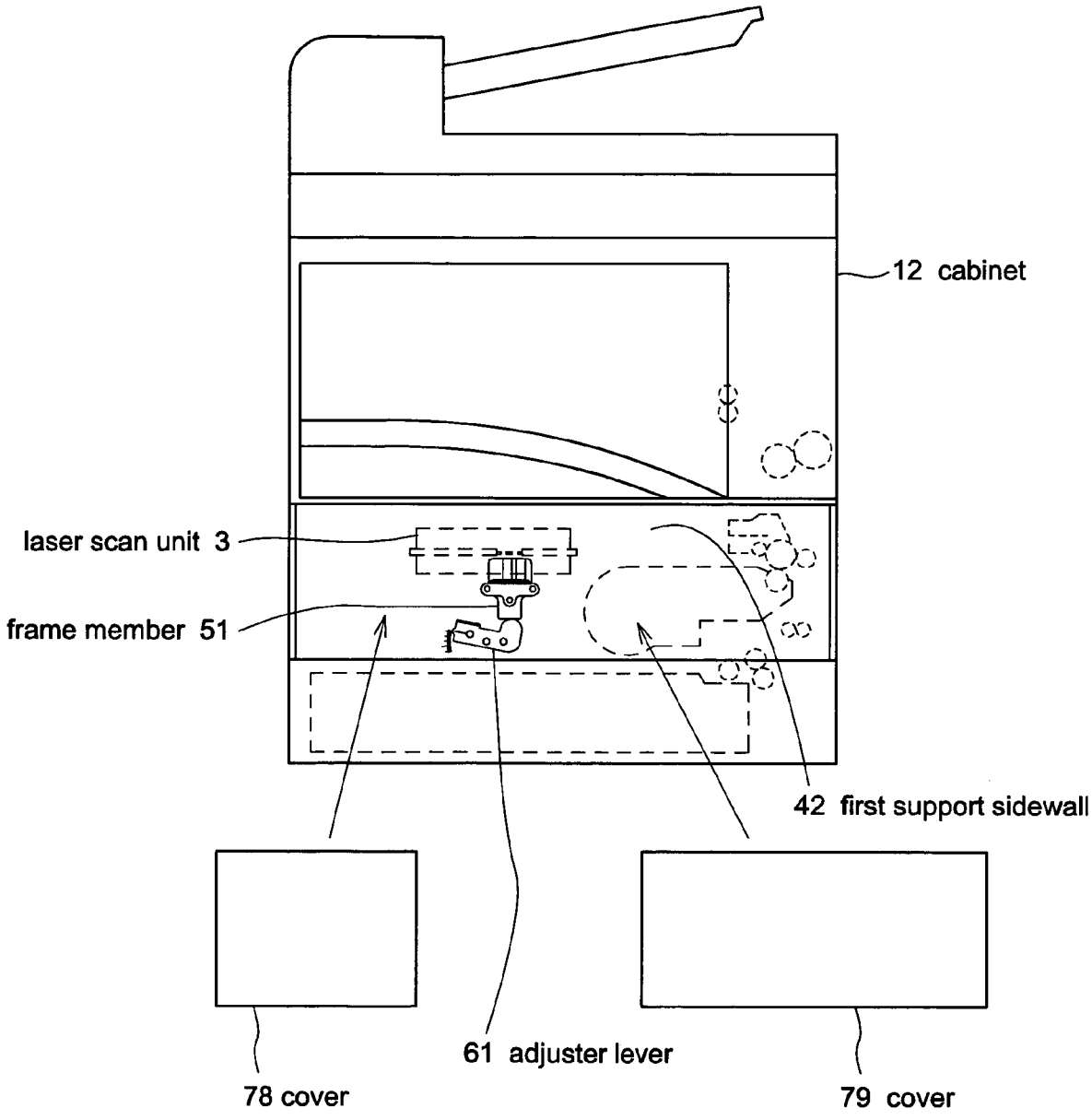
FIG. 7 is a frontal view of the FIG. 1 image forming apparatus with covers removed.

FIG. 7 is a frontal view of the image forming apparatus shown in FIG. 1 but with the covers removed. As explained previously, adjuster lever 61 is attached to the external surface of first support sidewall 42. The grip part of adjuster lever 61 can be easily grasped, and the lever conveniently operated, when adjuster lever 61 is exposed during assembly when covers 78 and 79 (which comprise part of cabinet 12) are removed, and during maintenance when covers 78 and 79 are open. Furthermore, it becomes possible to use the indicator line on adjuster lever 61 and the indexing scale to read the amount of adjustment applied to laser scan unit 3.

While the adjustment operation requires that the screws be loosened and tightened, screws 55, which secure L-bracket 50 to first support sidewall 42 as shown in FIG. 5 and 6, can be easily installed, tightened, and loosened because their shank parts are oriented horizontally and their head parts lie against the external surface of first support sidewall 42.

Figure 8:
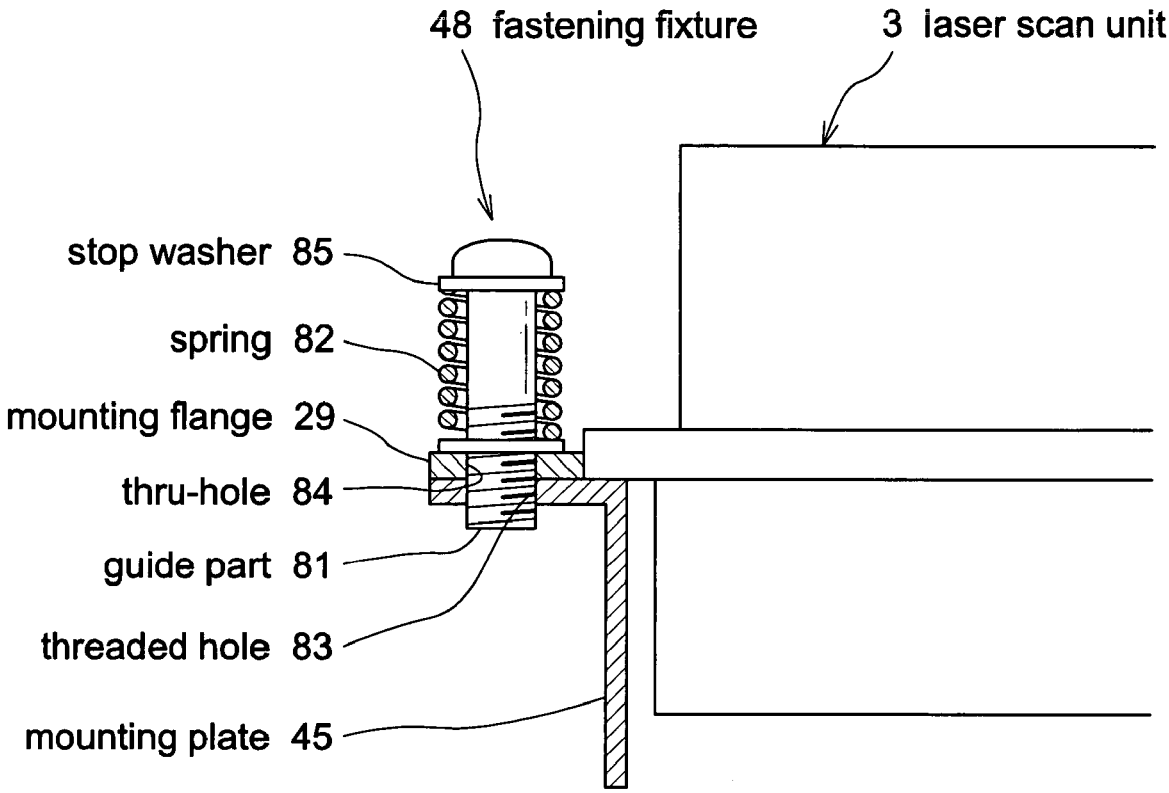
FIG. 8 is a is a cross section of the third mounting flange of the laser scan unit shown in FIG. 2.

FIG. 8 is a cross section illustrating the third mounting flange of the laser scan unit shown in FIG. 2. As-noted previously, laser scan unit 3 is attached to second mounting plate 45 through spring-loaded fastening fixture 48 that allows attitude changes in laser scan unit 3 made through the adjustment mechanism. Spring-loaded fastening fixture 48 includes guide part 81 which allows the movement of third mounting flange 29 only in the vertical direction at a right angle to the light emission axis of laser scan unit 3, and spring 82 that pressurizes third mounting flange 29 against second mounting plate 45 at the initial position.

Guide part 81 fixedly attaches to threaded hole 83 formed in second mounting plate 45, and thru-hole 84 is provided in third mounting flange 29 of laser scan unit 3 in order to allow the vertical displacement of third mounting flange 29 of guide part 81. Spring 82 is installed, in a compressed state, between third mounting flange 29 and stop washer 85 which is located opposite and above second mounting plate 45, in order to clamp third mounting flange 29 of scanning gun 3 in a downward direction against second mounting plate 45.

Thus structured, spring-loaded fastening fixture 48 allows the vertical movement of third mounting flange 29 of laser scan unit 3 while restricting its horizontal movement, therefore regulating the distance between laser scan unit 3 and photo conductor 1. Spring-loaded fastening fixture 48 secures laser scan unit 3 in a manner that allows its adjustment to a desired position, therefore maintaining precision focus of the light beam emitted from laser scan unit 3 on the imaging surface of the image support body (photo conductor 1) regardless of the operation of the adjustment mechanism.

Figure 9:
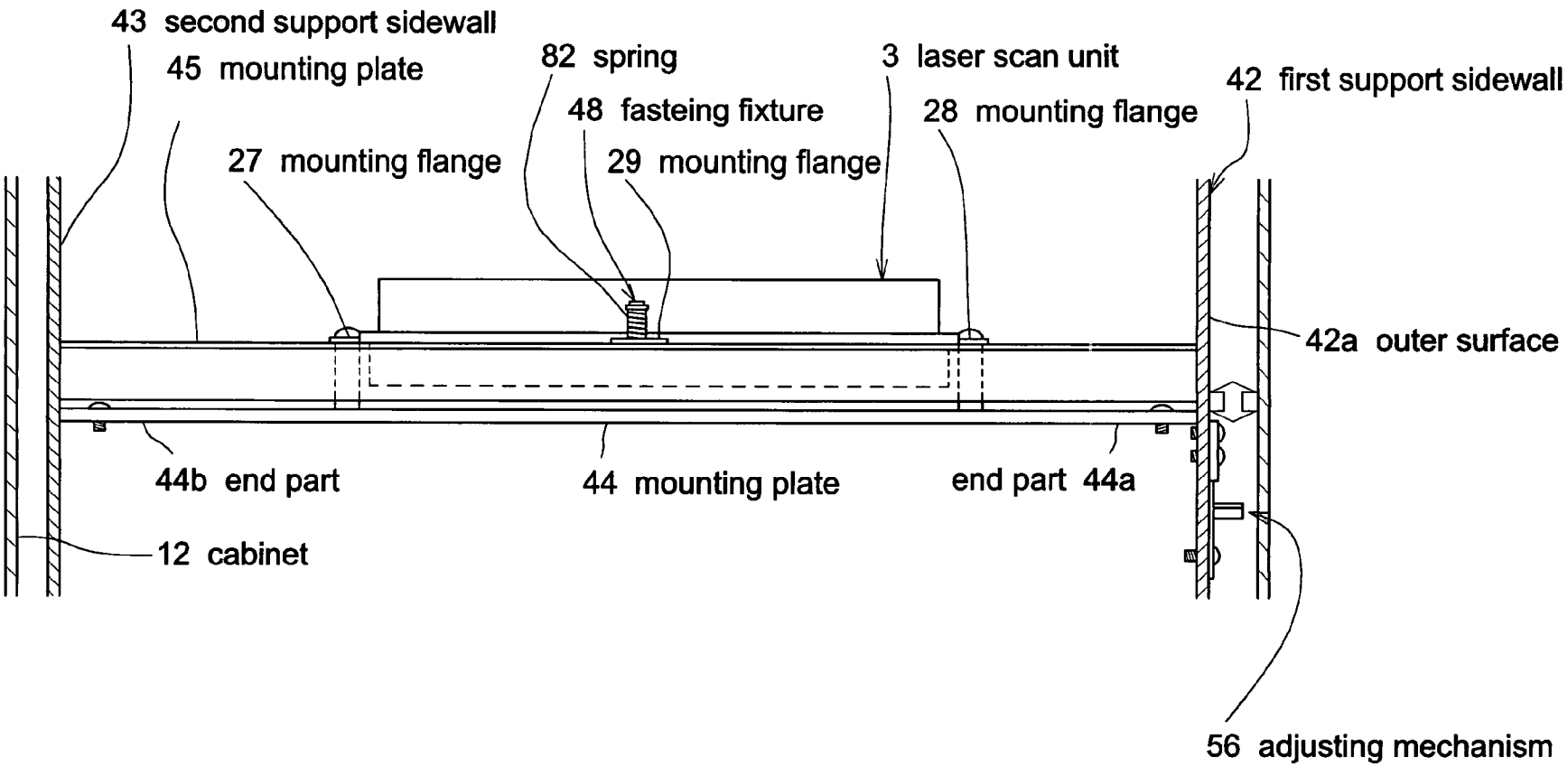
FIG. 9 is a side view of the laser scan unit support structure shown in FIG. 1.

FIG. 9 is a side view of the laser scan unit support structure shown in FIG. 1. The upward displacement of end part 44*a* of first mounting plate 44, brought about through the operation of adjustment mechanism 56, has the effect of upward moving of third mounting flange 29 of laser scan unit 3 and thus compressing spring 82. The downward displacement of end part 44*a* of first mounting plate 44, brought about through the operation of adjustment mechanism 56, has the effect of lowering third mounting flange 29 and thus decompressing spring 82. Adjustment mechanism 56 displaces first mounting plate 44 through a curved path, and allows precision altitude changes of laser scan unit 3.

Second Embodiment

Figure 10:
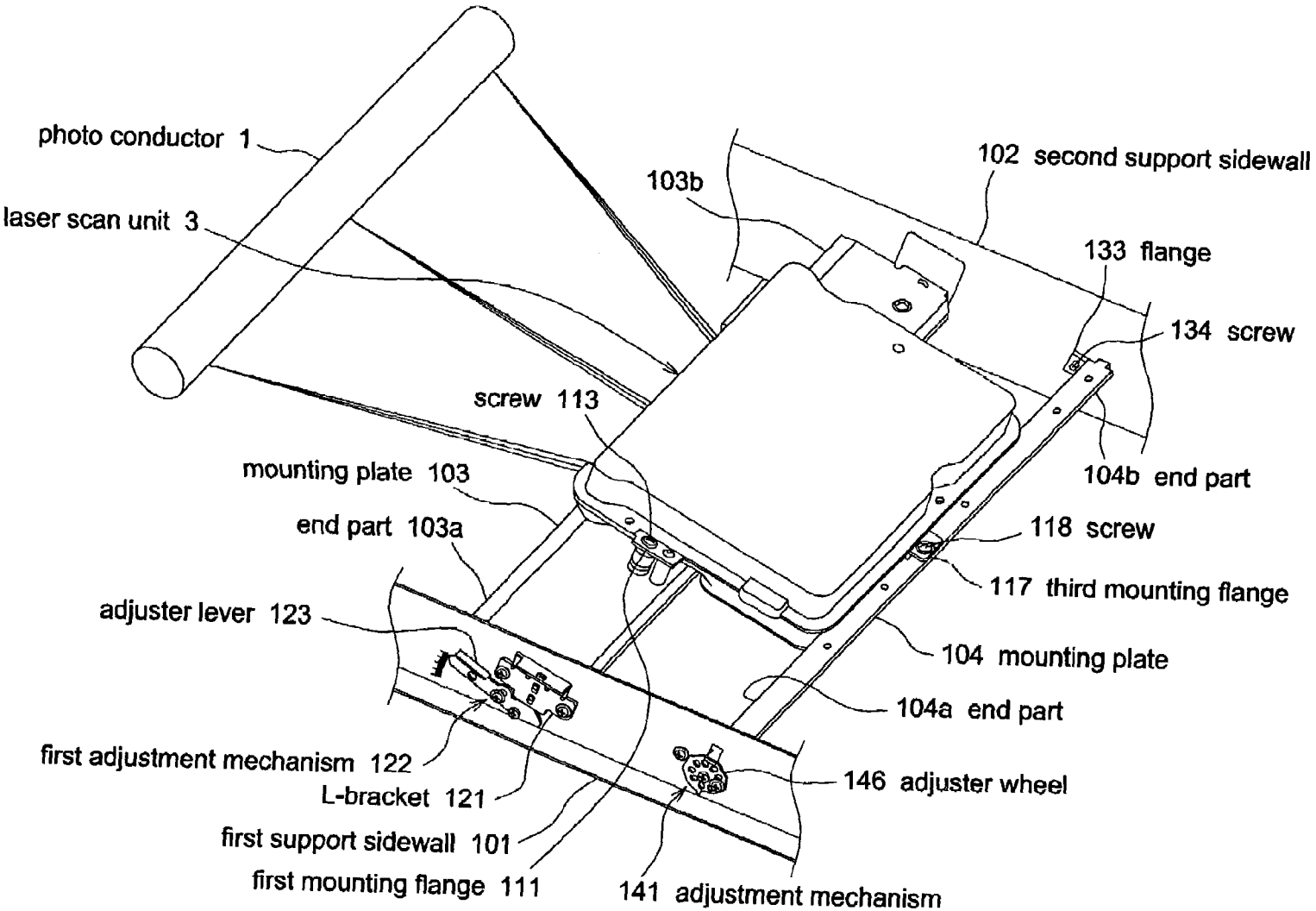
FIG. 10 is a perspective view on an additional embodiment of the laser scan unit support structure.
Figure 11:
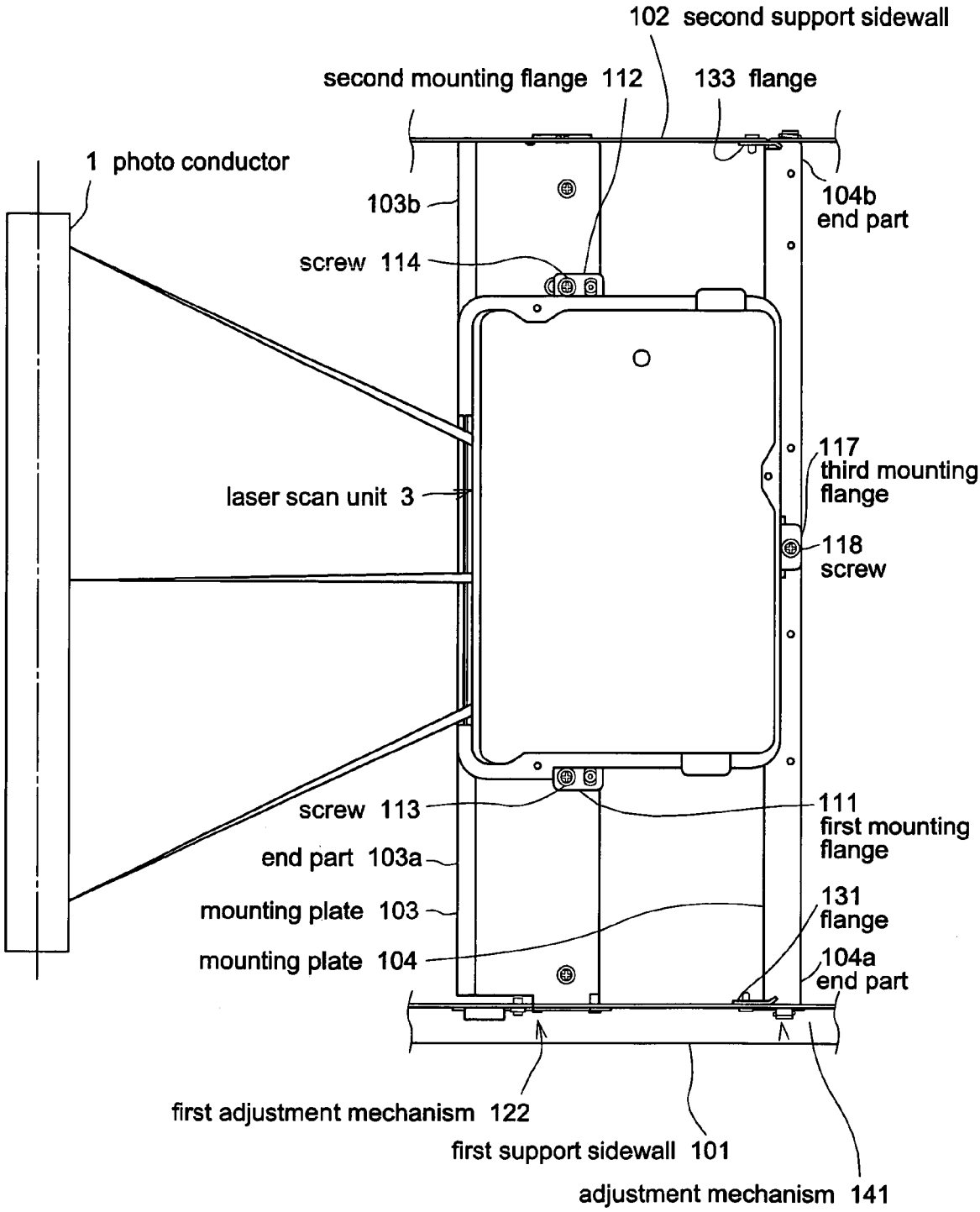
FIG. 11 is a top view of the laser scan unit support structure shown in FIG. 10.

FIG. 10 is a perspective drawing of a second embodiment of the support mechanism of the laser scan unit as prescribed by the invention. FIG. 11 is a top view, FIG. 12 is a rear view, and FIG. 13 is a side view of the support mechanism of the laser scan unit shown in FIG. 10.

In a similar structure to that described for the previous embodiment, laser scan unit 3 is supported by forward and rearwardly positioned first and second mounting plates (first and second support members) 103 and 104, said members 103 and 104 extending approximately horizontally along the scanning direction of laser scan unit 3, between first support sidewall 101 which is located on one side of the image forming apparatus cabinet, and second support sidewall 102 which is located on the other side of said cabinet.

As shown in FIG. 11, similar to the first mounting plate 44 structure of the previous embodiment, the forward portion of laser scan unit 3, located in opposition to photo conductor 1, is fixed on first mounting plate by first and second mounting flanges 111 and 112 and screws 113 and 114. As shown in FIG. 10, L-bracket 121, which is similar in structure to previously noted L-bracket 50, is provided on end part 103*a* which forms one end of first mounting plate 103.

Figure 12:
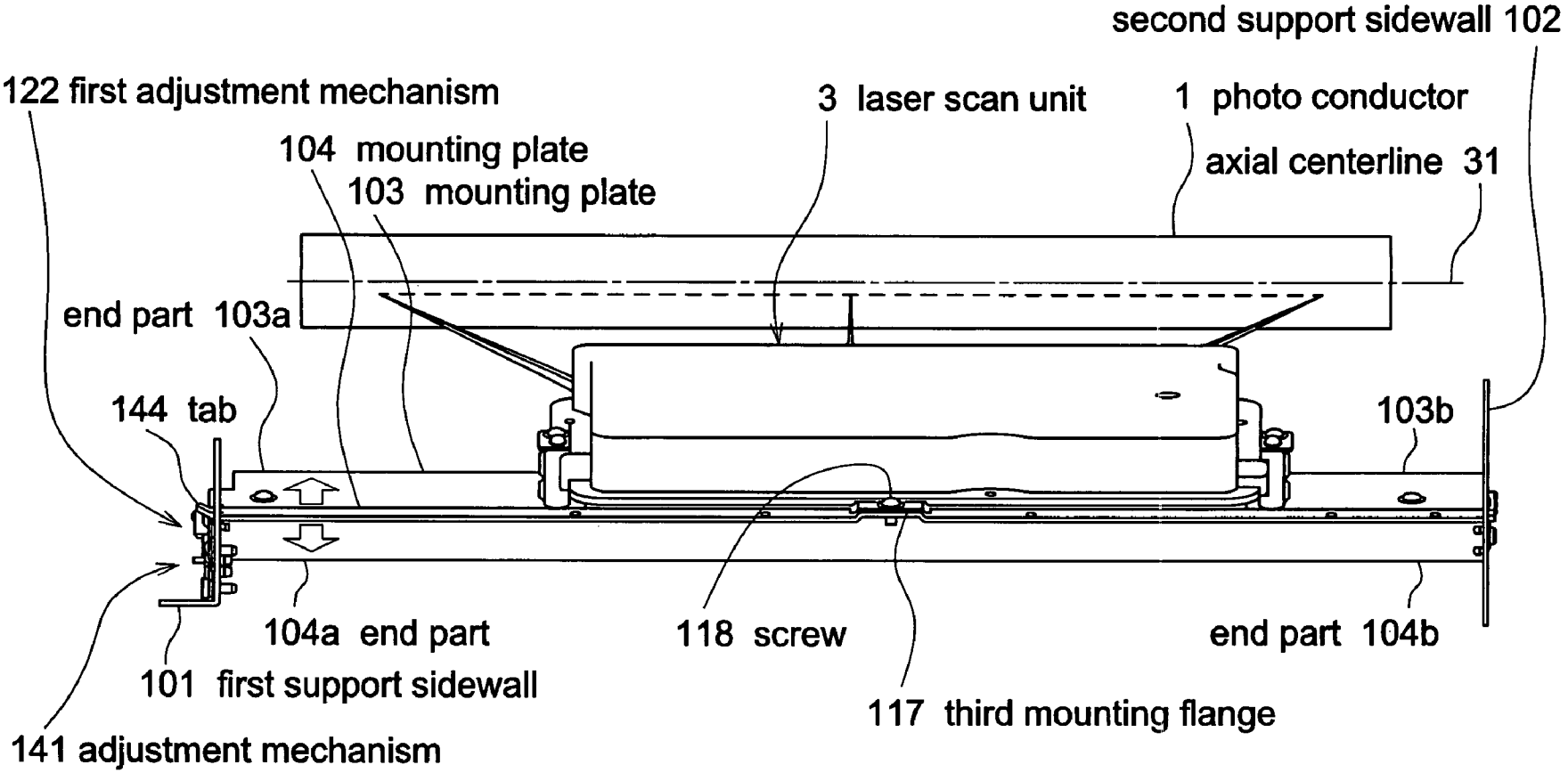
FIG. 12 is a rear view of the laser scan unit support structure as shown in FIG. 10.
Figure 13:
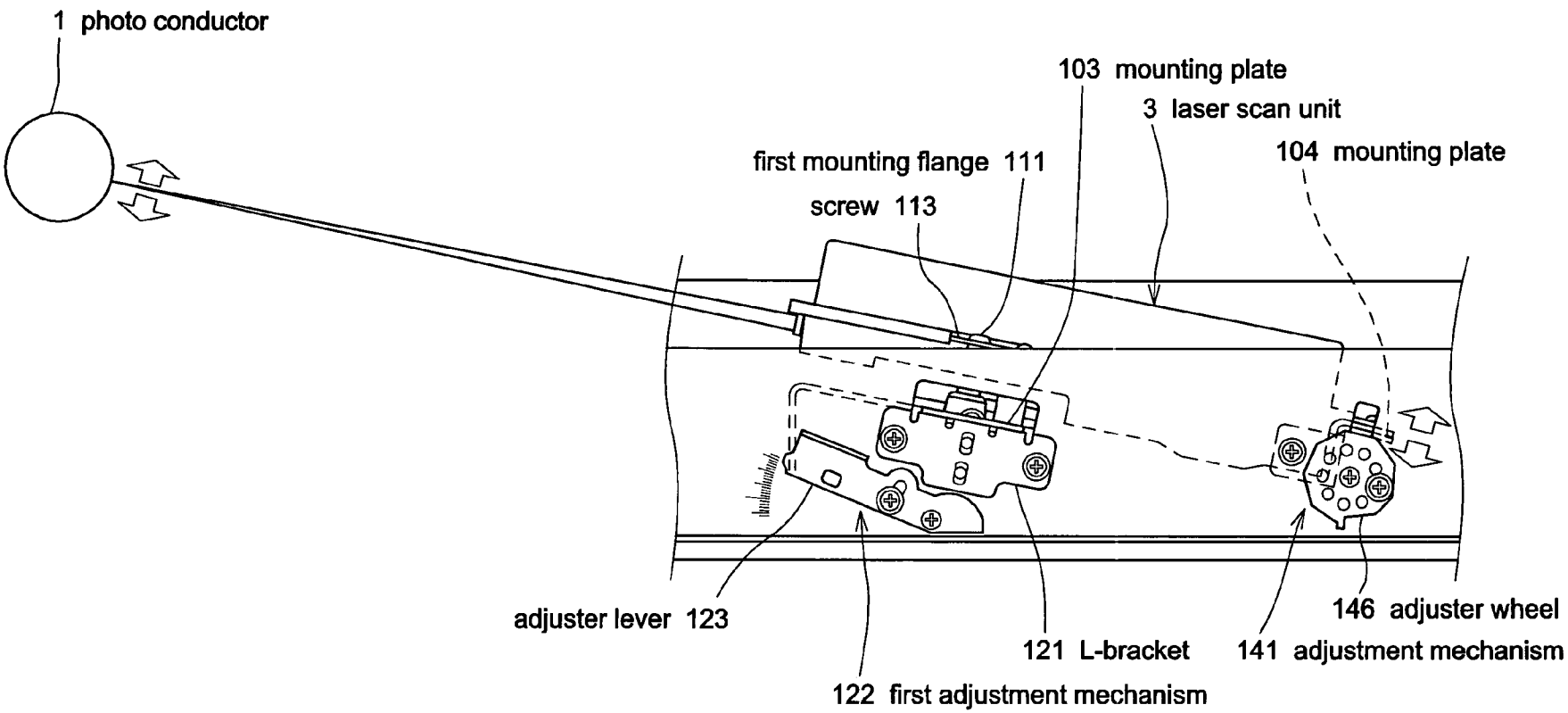
FIG. 13 is a side view of the laser scan unit support structure as shown in FIG. 10.

As shown in FIGS. 12 and 13, laser scan unit 3 also attaches to second mounting plate 104 through screws 118 and third mounting flange 117, which is located on the rear side of laser scan unit 3, opposite to photo conductor 1. The rear part of laser scan unit 3 is supported by second mounting plate 104. Note that this structure differs that of the previously embodiment in that third mounting flange 117 attaches directly and fixedly to second mounting plate 104 through screws 118.

Figure 14:
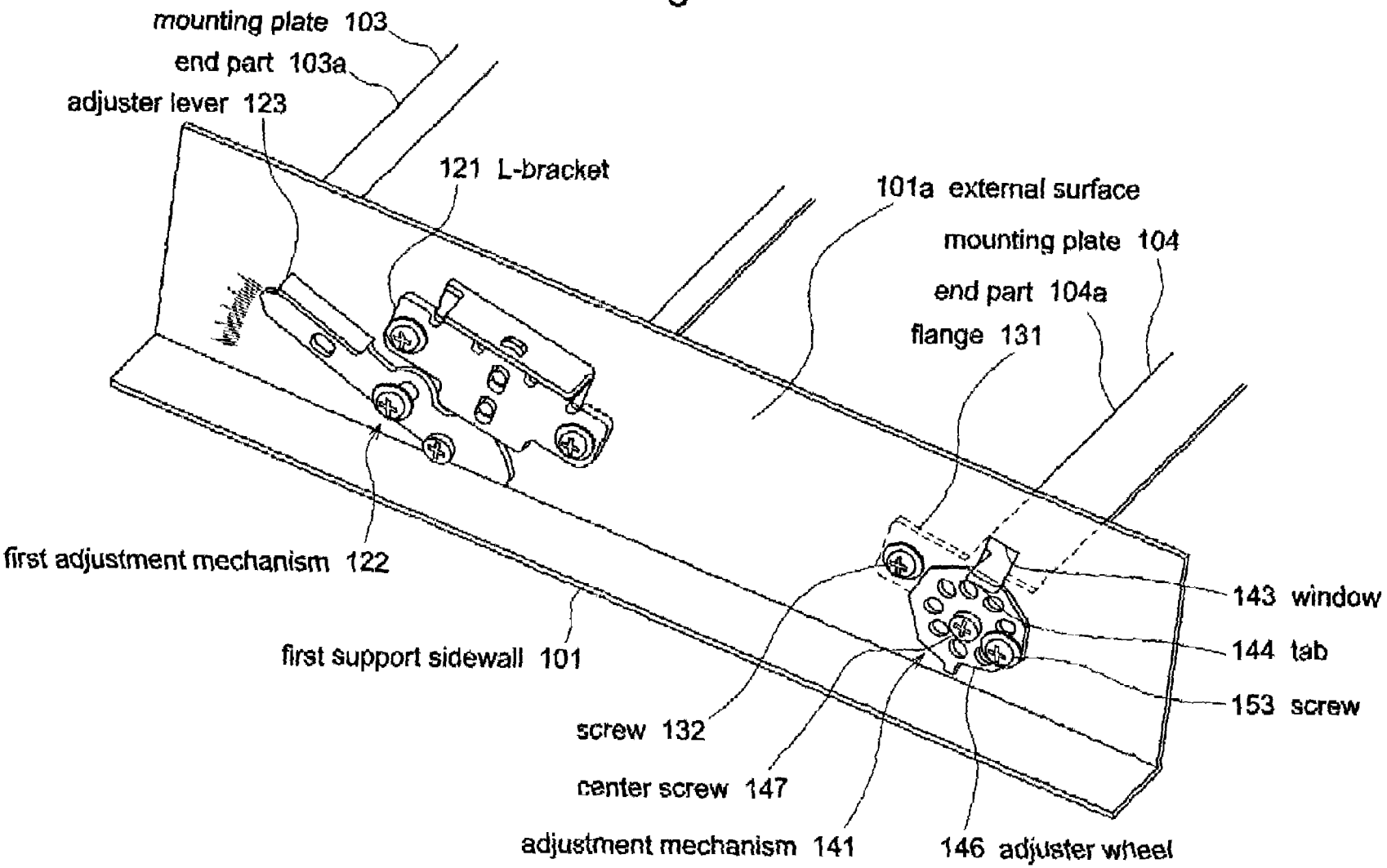
FIG. 14 is a partial perspective view of the laser scan unit support structure shown in FIG. 10.

FIG. 14 is a perspective view of a part of the laser scan unit support structure shown in FIG. 10. First adjustment mechanism 122, which is essentially similar to adjustment mechanism 56 of the previous embodiment, is provided on external surface 101*a* of fist support sidewall 101. As shown in FIG. 10, the operation of adjuster lever 123 displaces end part 103*a* of first mounting plate 103 in the vertical direction at an approximate right angle to the scanning axis, pivots laser scan unit 3 on end part 103*b* on the other end of first mounting plate 103, and thus forms a mechanism able to adjust the attitude of laser scan unit 3.

As shown in FIG. 14, flange 131, which is a bend-formed L-shaped extremity of end part 104*a* of second mounting plate 104, attaches to the inner surface of first support sidewall 101 through screws 132. Second adjustment mechanism 141, which is provided at external surface 101*a* of first support sidewall 101, is able to adjust the scanning position of laser scan unit 3 through the vertical displacement of end part 104*a* of second mounting plate 104.

As shown in FIG. 10, flange 133, which is formed as an L-shaped part of end part 104*b* at the other end of second mounting plate 104, attaches to the inner surface of second support sidewall 102 through screws 134. As end part 104*b* of second mounting plate 104 rigidly connects with and second support sidewall 102, raising or lowering end part 104*a* of second mounting plate 104, as a result of the operation of second adjustment mechanism 141, has the effect of having second mounting plate 104 vertically bent and the effect of having second mounting plate 104 slightly twisted around its centerline. Furthermore, end part 104*b*, which forms the other end of second mounting plate 104, may be structured to pivot around screw 134.

As can be seen in FIG. 14, tab 144, which is formed as an extension of end part 104*a* of second mounting plate 104, protrudes through window 143, which is formed in first support sidewall 101, and pasts the outer surface of sidewall 101. Window 143 allows the vertical movement of tab 144 within a predetermined range. Loosening screw 132 allows flange 131 to pivot on screw 132 which has the effect of displacing end part 104*a* of second mounting plate 104 in the vertical direction.

Second adjustment mechanism 141 incorporates adjuster wheel 146 that displaces second mounting plate 104, through contacting with tab 144, in relation to first support sidewall 101. Adjuster wheel 146 pivots on the axial center of center screw 147 (i.e. support shaft) which is attached to first support sidewall 101, said pivoting movement being enabled by hand or through the use of an appropriate tool.

Figure 15:
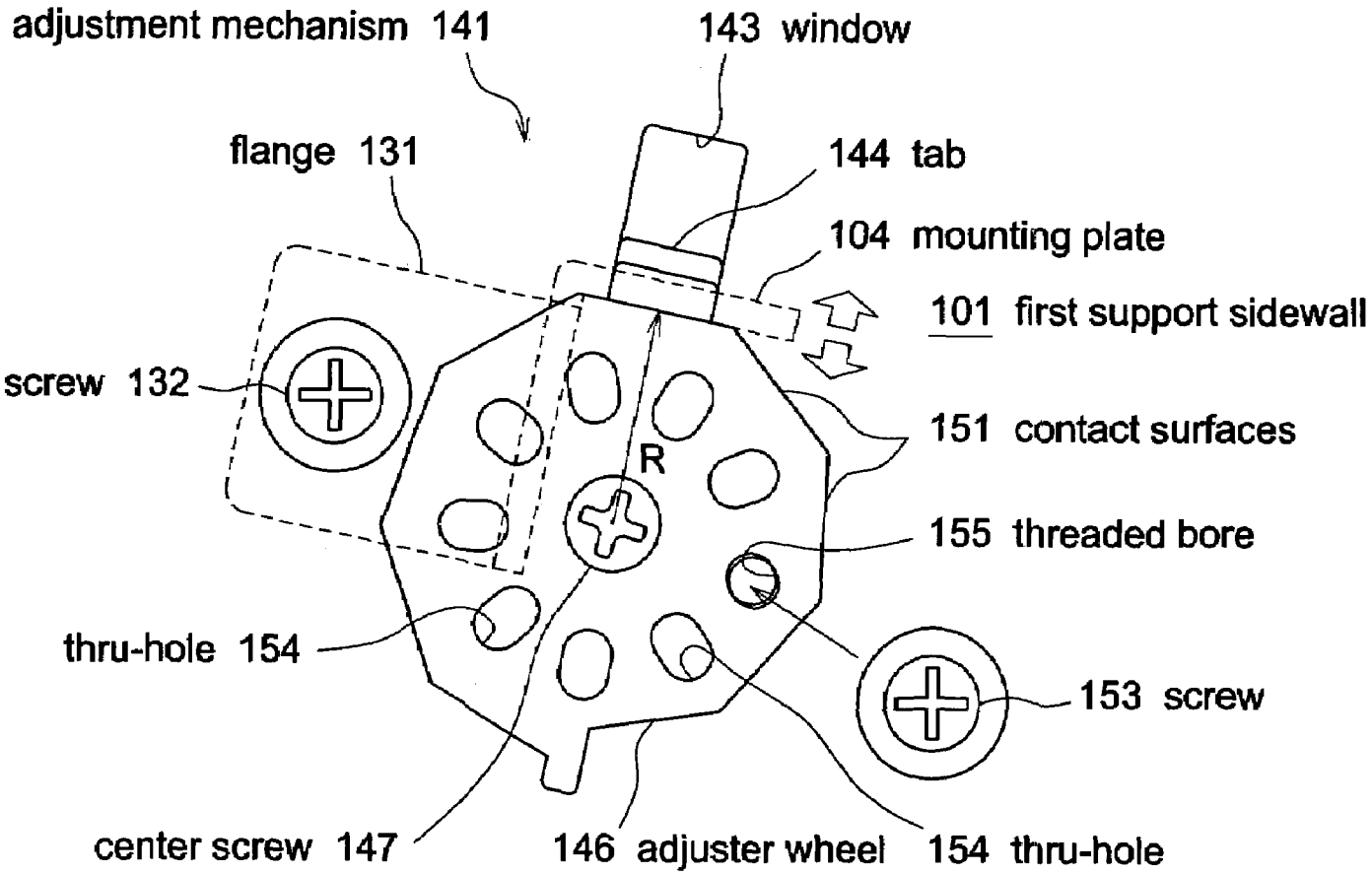
FIG. 15 is a partial side view of the laser scan unit support structure shown in FIG. 10.

FIG. 15 is a side view of the relevant part of the laser scan unit support mechanism shown in FIG. 10. Adjuster wheel 146 has a varying radius whereby different points on the periphery of adjuster wheel 146 have different radial distances to center screw 147. This structure differs from first adjustment mechanism 122 in that adjuster wheel 146 incorporates multiple flat circumferential contact surfaces 151, each contact surface 151 having a longer radial dimension, in respect to center screw 147, than the preceding one so as to form a stepped circumference on adjuster wheel 146. As any contact surface 151 may be brought into contact with the lower surface of tab 144, tab 144 can be secured at various incremental positions in respect to center screw 147.

Adjuster wheel 146 has a total of nine contact surfaces 151 that provide nine adjustment positions. Turning adjuster wheel 146 in a clockwise direction, as viewed in FIG. 16, will move tab 144 to incrementally higher positions, while turning adjuster wheel 146 in a counter-clockwise direction will move tab 144 to incrementally lower positions.

Moreover, adjuster wheel 146 is provided with thru-holes 154 through which screw 153 may be inserted as means of securing adjuster wheel 146 at a specific adjustment position. Each thru-hole 154 corresponds to a specific contact surface 151. The insertion of screw 153 through thru-hole 154 and its secure attachment to threaded bore 155, which is provided in first support sidewall 101, forms a mechanism able to lock adjuster wheel 146 to the desired position.

The operation of second adjustment mechanism 141 is executed with screw 132 loosened, said screw 132 being used to secure flange 131 of second mounting plate 104. The rotational movement of adjuster wheel 146 has the effect of vertically displacing tab 144 while pivoting flange 131 on the shaft of screw 132. As shown in FIG. 10, second mounting plate 104, of which one end is secured through end part 104*b*, is able to incline a small amount vertically and to twist, thus making it possible to vertically displace third mounting flange 117. Laser scan unit 3 is secured at one point on second mounting plate 104 through screw 118, and second mounting plate 104 is less solid than first mounting plate 103. Therefore, the inclination of second mounting plate 104 has little effect on the set position of laser scan unit 3, thereby providing a mechanism through which the only effect applied to laser scan unit 3 by the inclination of second mounting plate 104 is the vertical displacement of the rear portion of laser scan unit 3.

While the rear portion of laser scan unit 3 can be vertically displaced through the effect of second adjustment mechanism 141 on second mounting plate 104, the adjustable inclination of laser scan unit 3 is centered along the support axis of first mounting plate 103. In other words, the set position of laser scan unit 3 can be adjusted through establishing its inclination in respect to the axial center line of photo conductor 1 in the horizontal direction.

Figure 16A:
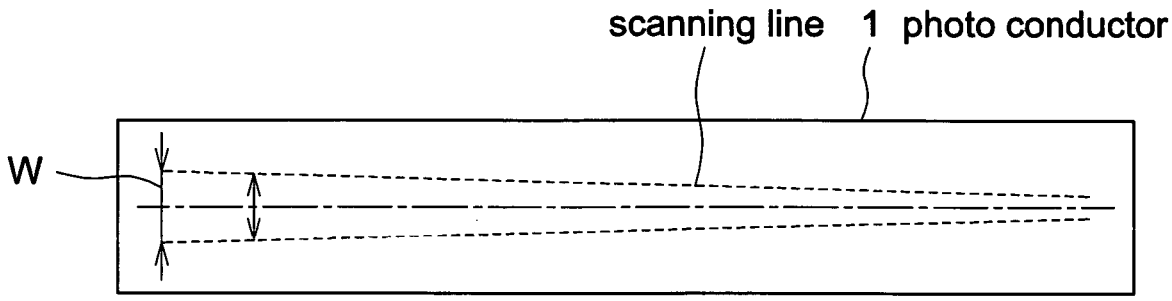
FIGS. 16(A) and 16(B) are scanning line adjustment diagrams relating to the laser scan unit support structure shown in FIG. 10.
Figure 16B:
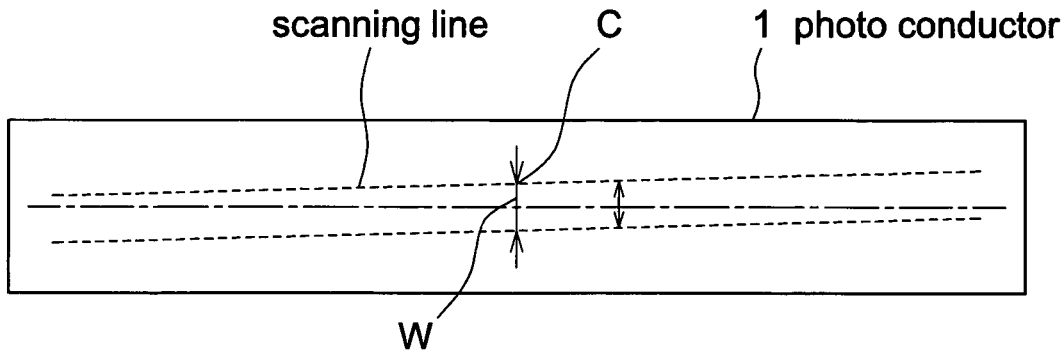

FIG. 16 is a diagram illustrating the adjustment that can be applied to the scanning position in regard to the laser scan unit support mechanism shown in FIG. 10. FIG. 16A shows the effect of first adjustment mechanism 122 which is able to adjust the inclination angle of the scanning line. Adjustment range W, which shows the angle within which the scanning line can be inclined through first adjustment mechanism 122, may cover an adjustment range within which the scanning line can, for example, be moved up 2.38 mm or down 2.28 mm from the center of the surface on photo conductor 1. FIG. 16B shows the effect of second adjustment mechanism 141 through which the position of scanning line center C (beam spot along the primary scanning direction) can be adjusted vertically (the secondary scanning direction) at an approximately right angle to the scanning direction. Adjustment range W, within which second adjustment mechanism 141 is able to adjust the scanning position, may be established, for example, to provide 1.51 mm of adjustment above the mid-point of the surface of photo conductor 1, and 1.51 mm of adjustment below. The actual scanning line adjustment is executed by initially adjusting the scanning line inclination angle with first adjustment mechanism 122, and then adjusting the center point of the scanning line with second adjustment mechanism 141. The result is an easy and accurate scanning line adjustment operation.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2003-67763 filed on Mar. 13, 2003 and the Japanese Patent Application No. 2004-025311 filed on Feb. 2, 2004, entire content of which is expressly incorporated by reference herein.

What is claimed is:

1. A support apparatus supporting a laser scan unit, the laser scan unit being configured to be utilized in an image forming apparatus and to cooperate with a photo conductor of the image forming apparatus, the support apparatus comprising:

a mounting plate configured to have the laser scan unit mounted thereon;

a support plate configured to support the mounting plate within the image forming apparatus adjacent an end of the mounting plate, the support plate extending vertically within the image forming apparatus;

an adjuster configured to be positioned along the vertical extent of the support plate, and to adjust a height of an end of the mounting plate by moving the end of the mounting plate upward and downward, the adjuster being configured to be accessed from a side of the image forming apparatus, the adjuster comprising a cam and a lever, the cam contacting the end of the mounting plate, the lever being coupled with the cam, the cam moving the end of the mounting plate upward and downward by rotation of the lever about a fulcrum; and a scale configured to display height levels of the end of the mounting plate, the scale being provided on the support plate, and being adjacent an end of the lever of the adjuster.

2. The support apparatus according to claim 1, wherein the other end of the mounting plate is fixed at the support plate.

3. The support apparatus according to claim 1, wherein the lever is combined with the cam in L-shape.

4. The support apparatus according to claim 1, wherein the lever has a grip at the end thereof.

5. The support apparatus according to claim 1, wherein the scale is enlarged by being spaced from the fulcrum of the adjuster so that the scale can be read when the height of the end of the mounting plate is adjusted.

6. The support apparatus according to claim 1, wherein the scale displays an average level of the height of the end of the mounting plate.

7. The support apparatus according to claim 1 further comprising a fixer configured to fix the laser scan unit in the image forming apparatus, at a rear side of the laser scan unit with respect to the photo conductor, the fixer configured to permit adjusting the height of the rear side of the laser scan unit upward and downward.

8. The support apparatus according to claim 7, wherein the fixer comprises a spring configured to push the rear side of the laser scan unit toward a predetermined position.

9. The image forming apparatus according to claim 1, said cam being integral with said lever.

10. The image forming apparatus according to claim 1, said lever being mounted to pivot about a shaft, said cam being positioned closer to said shaft than a distance between an end of said lever adjacent said scale and said shaft.

11. A support apparatus supporting a laser scan unit, the laser scan unit being configured to be utilized in an image forming apparatus and to cooperate with a photo conductor of the image forming apparatus, the support apparatus comprising:

a mounting plate configured to have the laser scan unit mounted thereon;

a support plate configured to support the mounting plate within the image forming apparatus adjacent an end of the mounting plate, the support plate extending vertically within the image forming apparatus;

an adjuster configured to be positioned along the vertical extent of the support plate, and to adjust a height of an end of the mounting plate, the adjuster being configured to be accessed from a side of the image forming apparatus;

a second mounting plate configured to have the laser scan unit mounted thereon, at a rear side of the laser scan unit with respect with the photo conductor, the second mounting plate being supported within the image forming apparatus by the support plate; and a second adjuster configured to be positioned along the vertical extent of the support plate and to adjust a height of an end of the second mounting plate upward and downward by pivoting about the mounting plate, the second adjuster being positioned to be accessed from the side of the image forming apparatus, the second adjuster comprising a polygonal wheel having a plurality of side surfaces, a distance from a center of the polygonal wheel to each side surface of the polygonal wheel being different, the height of the edge of the second mounting plate being adjusted by rotating the polygonal wheel so that a different side surface supports the second mounting plate.

12. The support apparatus according to claim 11, wherein the other end of the second mounting plate is fixed at the support plate.

13. The support apparatus according to claim 11, wherein the adjuster and the second adjuster are positioned at about a same vertical level of the support plate.

14. An image forming apparatus utilizing a laser scan unit, the image forming apparatus comprising:

a laser scan unit configured to cooperate with a photo conductor;

a mounting plate configured to have the laser scan unit mounted thereon;

a support plate configured to support the mounting plate within the image forming apparatus, the support plate extending vertically within the image forming apparatus;

an adjuster configured to be positioned along a vertical extent of the support plate, and to adjust a height of an end of the mounting plate by moving the end of the mounting plate upward and downward, the adjuster configured to be accessed from a side of the image forming apparatus, the adjuster comprising a cam and a lever, the cam contacting the end of the mounting plate, the lever being coupled with the cam, the cam moving the end of the mounting plate upward and downward by rotation of the lever about a fulcrum; and a scale configured to display height levels of the end of the mounting plate, the scale being provided on the support plate, and being near an end of the lever of the adjuster.

15. The image forming apparatus according to claim 14 further comprising a fixer configured to fix the laser scan unit in the image forming apparatus, at a rear side of the laser scan unit with respect to the photo conductor, the fixer configured to permit adjusting the height of the rear side of the laser scan unit upward and downward.

16. The image forming apparatus according to claim 15, said fixer comprising a spring loaded member.

17. The image forming apparatus according to claim 14 further comprising a second mounting plate configured to have the laser scan unit mounted thereon, at the rear side of the laser scan unit with respect to the photo conductor, the second plate being supported within the image forming apparatus by the support plate, and further comprising a second adjuster configured to be positioned along the vertical extent of the support plate and to adjust a height of an end of the second mounting plate, the second adjuster being capable of being accessed from the side of the image forming apparatus.

18. The image forming apparatus according to claim 17, wherein the adjuster and the second adjuster are positioned at about a same vertical level of the support plate.

19. The image forming apparatus according to claim 17 further comprising a cover configured to cover the adjuster and the second adjuster, wherein the adjuster and the second adjuster are capable of being accessed from the same side of the image forming apparatus when the cover is removed from the image informing apparatus.

20. The image forming apparatus according to claim 14, said cam being integral with said lever.

21. The image forming apparatus according to claim 14, said lever being mounted to pivot about a shaft, said cam being positioned closer to said shaft than a distance between an end of said lever adjacent said scale and said shaft.

* * * * *